US006591996B1

(12) United States Patent
Wu

(10) Patent No.: US 6,591,996 B1
(45) Date of Patent: Jul. 15, 2003

(54) FRAMEWORK WITH ADJUSTABLE SHELVES

(75) Inventor: Chi-Ming Wu, Chang Hua (TW)

(73) Assignee: Luck Money International Co., Ltd., Chang Hua (TW)

( * ) Notice: Subject to any disclaimer, the term of this patent is extended or adjusted under 35 U.S.C. 154(b) by 0 days.

(21) Appl. No.: 10/040,835

(22) Filed: Jan. 9, 2002

(51) Int. Cl.[7] ..... A47F 5/08

(52) U.S. Cl. ..... 211/90.02; 211/94.01; 211/103; 211/187

(58) Field of Search ..... 211/90.01, 90.02, 211/103, 187, 94.01

(56) References Cited

U.S. PATENT DOCUMENTS 1,554,137 A * 9/1925 Slifkin ..... 211/187
3,848,844 A * 11/1974 Barrett ..... 211/134
4,103,855 A * 8/1978 Grosse ..... 248/246
4,156,515 A * 5/1979 Mochly ..... 211/193
4,614,273 A * 9/1986 Ishii ..... 211/183
4,653,652 A * 3/1987 Avati ..... 211/189
4,779,830 A * 10/1988 Phelps ..... 211/187
4,901,965 A * 2/1990 Bowman ..... 248/246
5,318,264 A * 6/1994 Meiste ..... 248/222.12

* cited by examiner

*Primary Examiner*—Daniel P. Stodola
*Assistant Examiner*—Erica B Harris
(74) *Attorney, Agent, or Firm*—Harrison & Egbert

(57) ABSTRACT

A framework includes a support rail, at least one bracing element, and at least one shelf. The support rail is provided with a slide slot. The bracing element has a fastening portion and a retaining portion. The fastening portion is used to fasten the shelf. The retaining portion is formed of a slide block and a connection portion located between the slide block and the fastening portion. The slide block is slidably received in the slide slot of the support rail, whereas the connection portion juts out of the slide slot of the support rail.

2 Claims, 6 Drawing Sheets

FRAMEWORK WITH ADJUSTABLE SHELVES

BACKGROUND OF THE INVENTION

1. Field of the Invention

The present invention relates generally to a framework serving to hold or display various articles, and more particularly to a framework comprising a support rail and one or more shelves held on to the support rail at various angles by one or more bracing elements.

2. Description of Related Art

Conventional racks comprise a plurality of shelves which are fixedly retained and therefore cannot be adjusted in a situation calling for the adjustment of the shelves. Certain conventional racks comprise a plurality of shelves which can be adjusted in position. However, the adjustable shelves of conventional racks can be relocated only at a predetermined position. In addition, the process of adjusting the shelves of the conventional racks is rather inefficient.

BRIEF SUMMARY OF THE INVENTION

The primary objective of the present invention is to provide a framework serving to hold or display various articles. The framework comprises a support rail, at least one bracing element adjustably retained by the support rail, and at least one shelf fastened with the bracing element.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
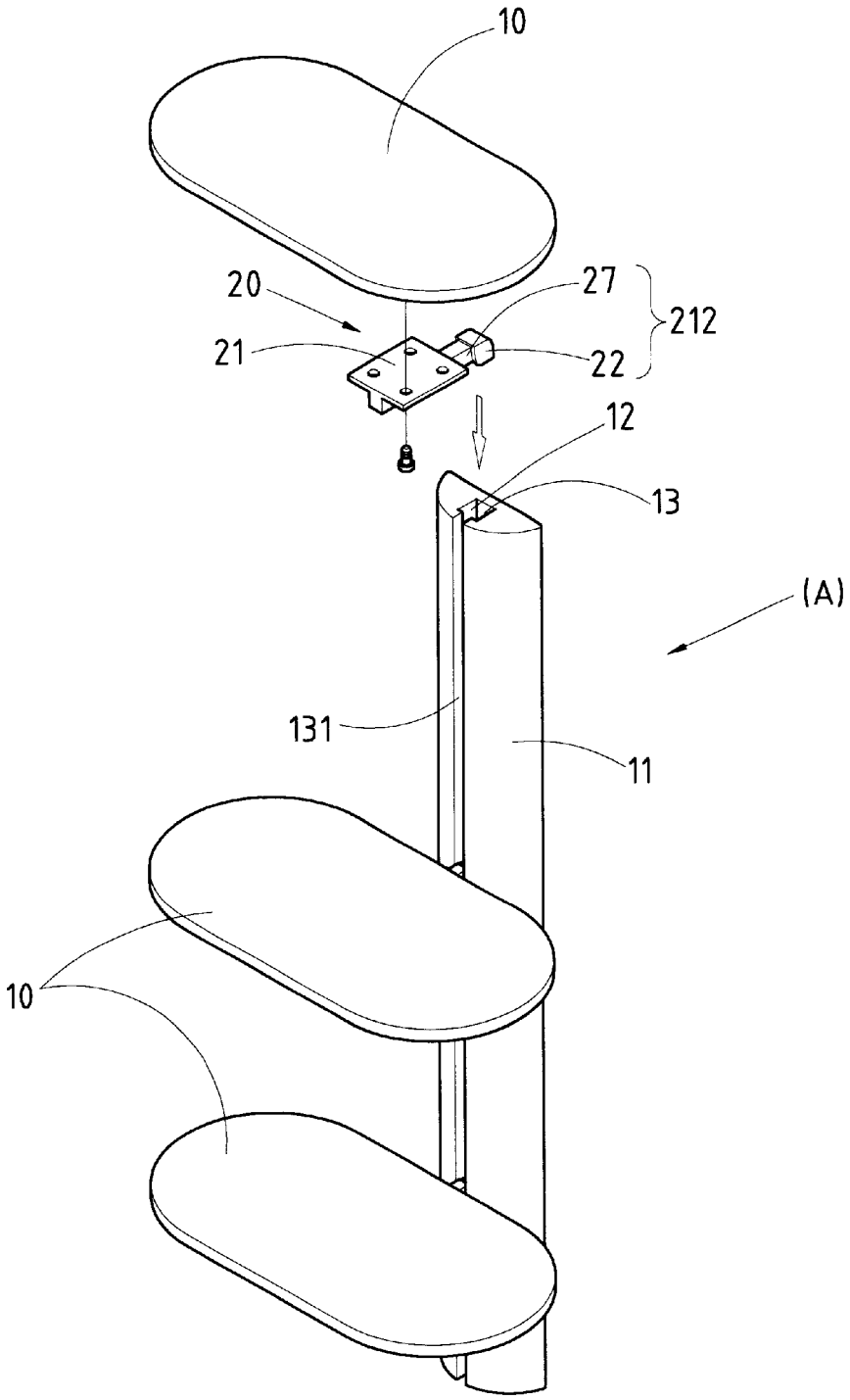
FIG. 1 shows an exploded perspective view of the preferred embodiment of the present invention.
Figure 2:
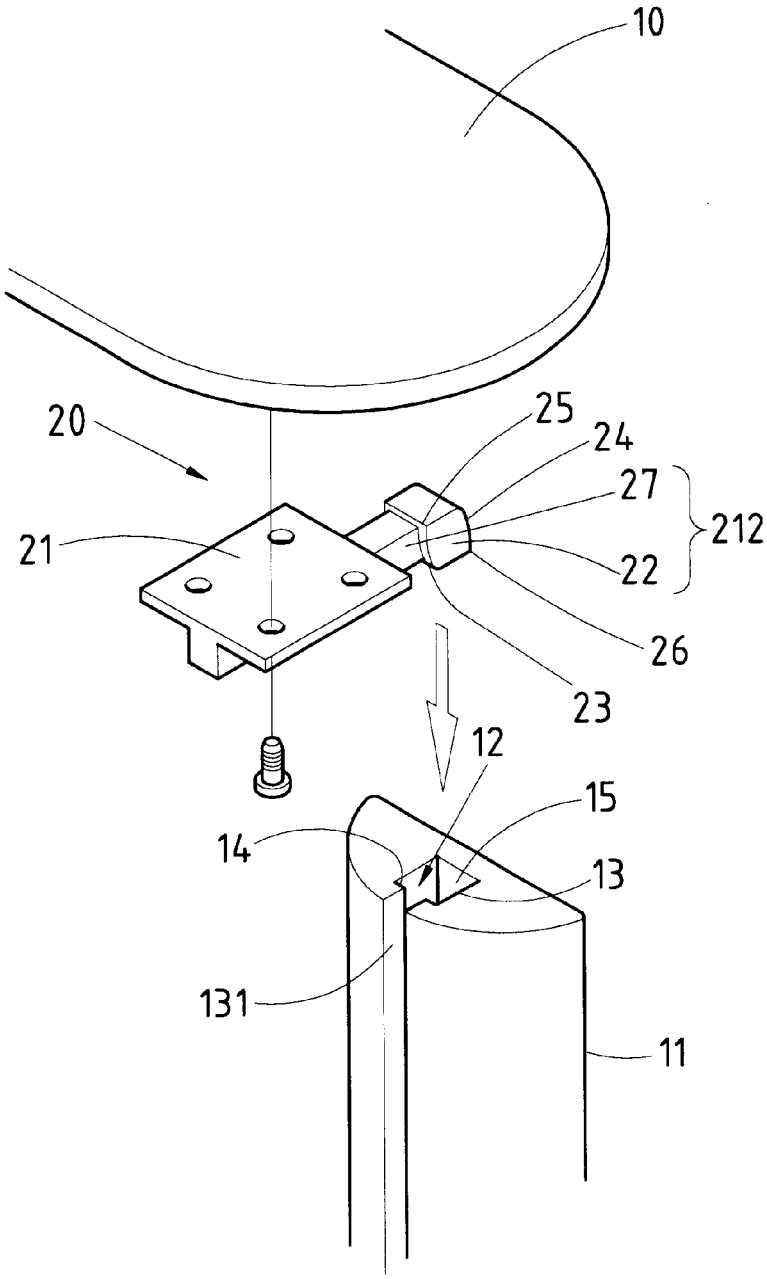
FIG. 2 shows a partial enlarged view of the preferred embodiment of the present invention.
Figure 3:
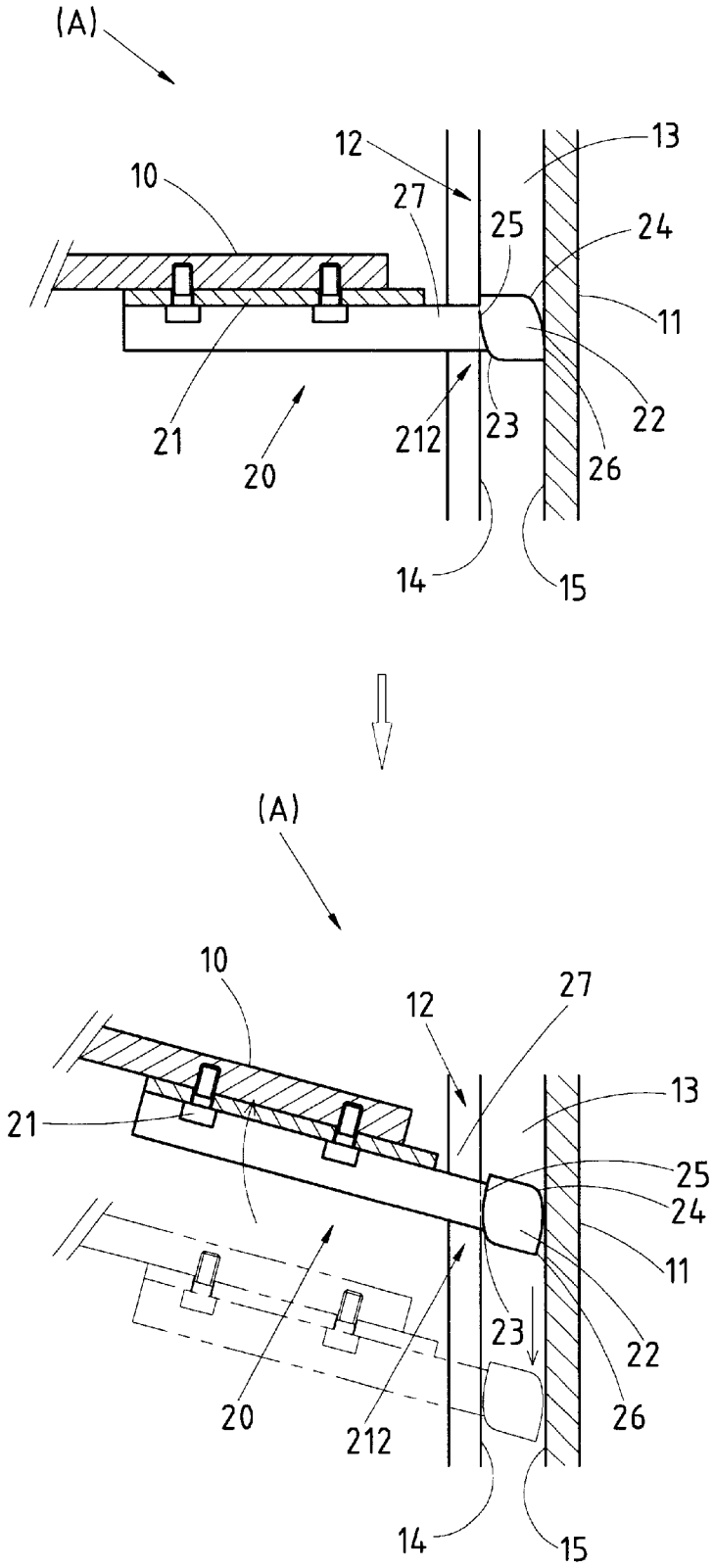
FIG. 3 shows a partial sectional schematic view of the preferred embodiment of the present invention.

As shown in FIGS. 1–3, a framework "A " embodied in the present invention comprises a support rail 11, one or more shelves 10, and one or more bracing elements 20.

The support rail 11 has a predetermined length and is provided with a slide slot 12 extending along the longitudinal direction of the support rail 11. The support rail 11 is further provided with an assembly slot 131 in communication with the slide slot 12 and extending along the longitudinal direction of the support rail 11. The slide slot 12 has an inner slot 13, a bottom wall 15, and a stop edge 14 located between the inner slot 13 and the bottom wall 15.

The bracing elements 20 have a fastening portion 21 which is fastened with the underside of the shelf 10. The bracing elements 20 further have a retaining portion 212 which is formed of a slide block 22 and a connection portion 27. The bracing element 20 is slidably retained in the slide slot 12 of the support rail 11 such that the slide block 22 is received in the inner slot 13, and that the connection portion 27 is extended out of the slide slot 12. The slide block 22 is provided with a front inclined edge 23 and a rear inclined edge 24. The front inclined edge 23 is in contact with the stop edge 14 of the slide slot 12, whereas the rear inclined edge 24 is in contact with the bottom wall 15 of the slide slot 12. The slide block 22 is provided with an upper corner 25 and a lower corner 26. The upper corner 25 is rested against the stop edge 14, whereas the lower corner 26 is rested against the bottom wall 15. The upper corner 25 and the lower corner 26 serve to retain securely the bracing element 20 in the slide slot 12 of the support rail 11.

Figure 4:
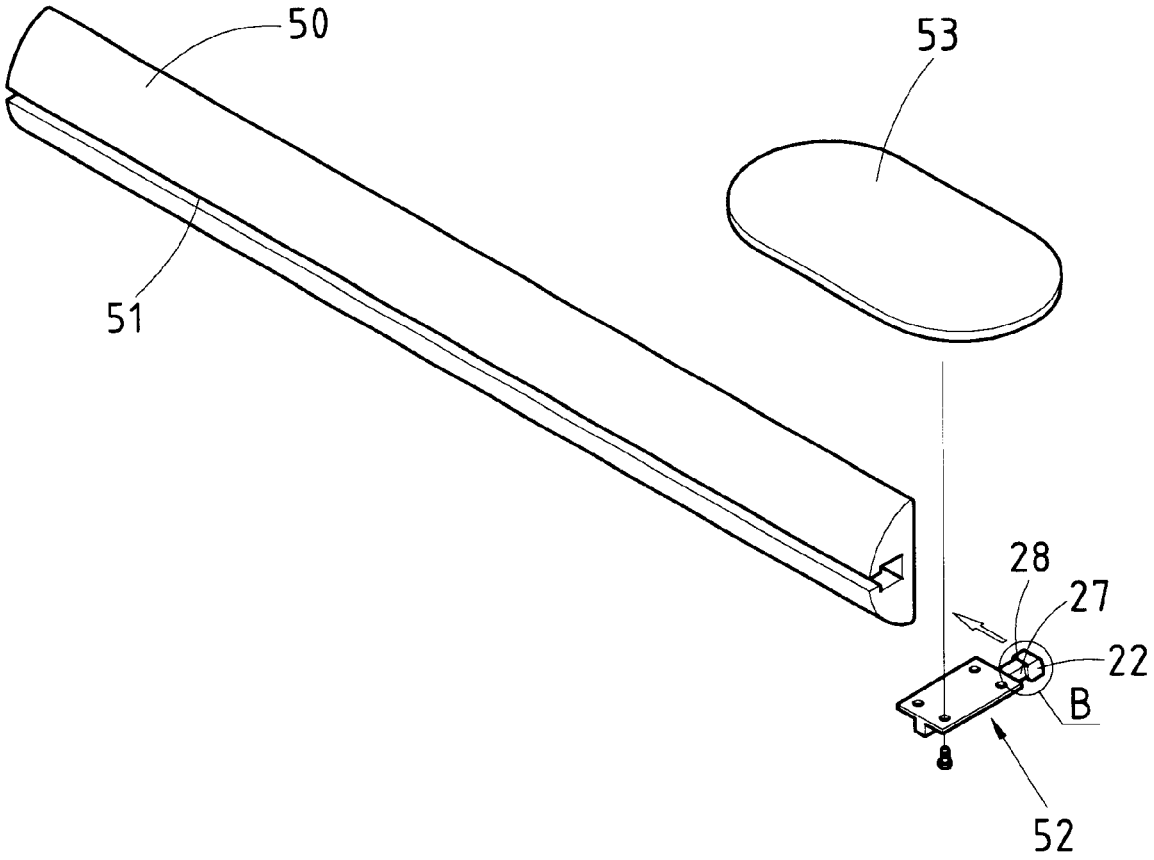
FIG. 4 shows another exploded perspective view of the present invention.
Figure 5:
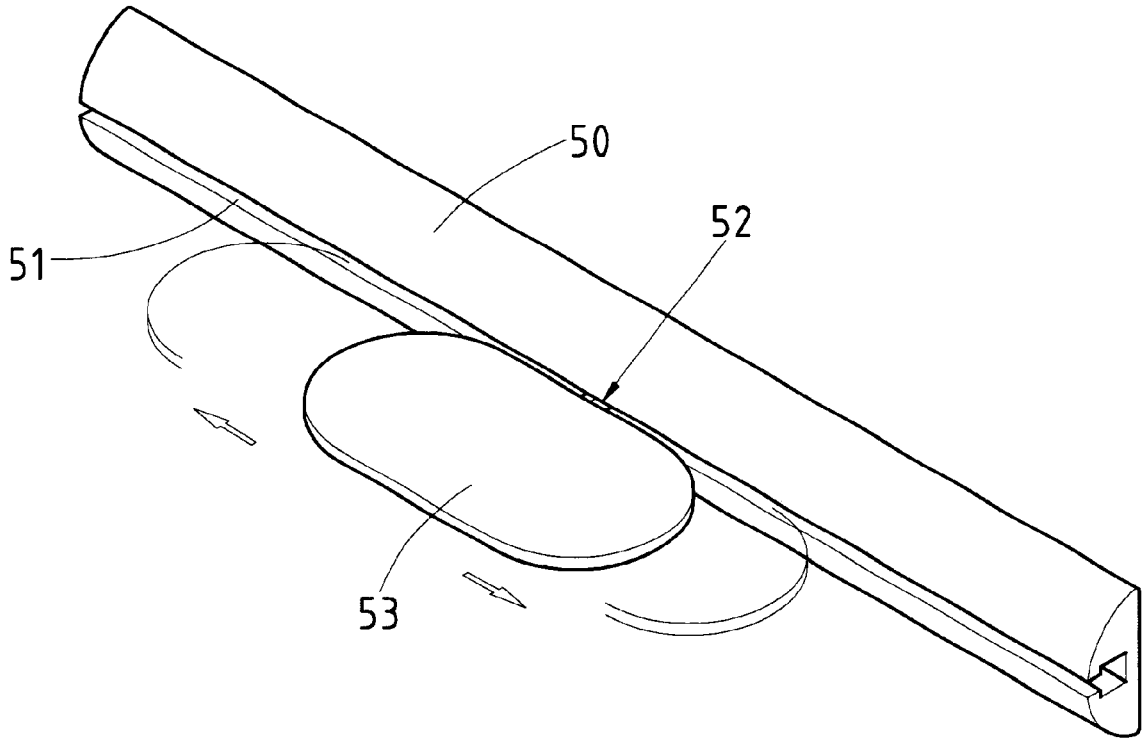
FIG. 5 shows a schematic view of a shelf of the present invention being adjusted.
Figure 6:
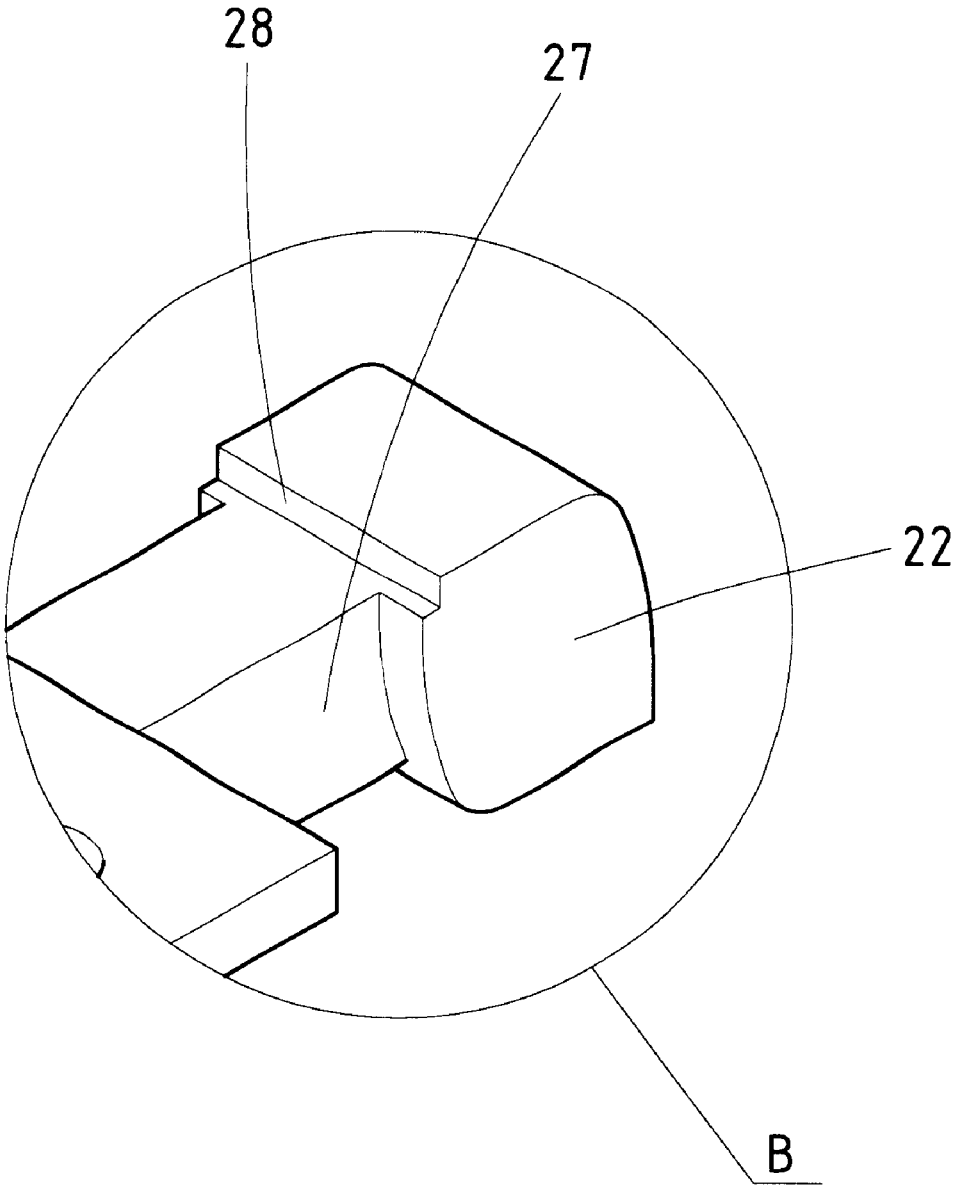
FIG. 6 shows an enlarged schematic view of a portion indicated by a circle "B " as shown in FIG. 4.

The support rail of the present invention may be erected uprightly, as shown in FIGS. 1–3, or horizontally, as shown in FIGS. 4–6 in which the framework comprises a support rail 50 with a slide slot 51, a bracing element 52, and a shelf 53. The bracing element 52 is provided in the upper corner of the front wall of the slide block 22 with a recessed edge 28 which is intended to facilitate the entry of the slide block 22 into the slide slot 51.

The present invention described above is to be regarded in all respects as being merely illustrative and not restrictive. Accordingly, the present invention may be embodied in other specific forms without deviating from the spirit thereof. The present invention is therefore to be limited only by the scope of the following appended claims.

The present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

I claim:

1. A framework comprising:

a support rail having a predetermined length, said support rail having a slide slot extending longitudinally along said support rail, said support rail having an assembly slot in communication with said slide slot and extending longitudinally therealong, said slide slot having a pair of side walls with a bottom wall extending between said pair of side walls, said slide slot having a planar stop edge extending inwardly from each of said pair of side walls;

at least one bracing element having a fastening portion and a retaining portion opposite to said fastening portion, said retaining portion comprising a slide block and a connection portion, said connection portion extending between said slide block and said fastening portion, said slide block having a front inclined end and a rear inclined end and an upper corner and a lower corner, said bracing element being slidably retained in said slide slot of said support rail, said slide block received in an inner slot of said slide slot, said connection portion extending through said assembly slot from said slide slot, said front inclined edge contacting said stop edge of said slide slot, said rear inclined edge of said slide block being in contact with said bottom wall of said slide slot, said upper corner of said slide block resting against said stop edge of said slide slot, said lower corner of said slide block resting against said bottom wall of said slide slot; and a shelf fastened to said fastening portion of the bracing element.

2. The framework of claim 1, aid upper corner of said slide block having a recessed edge at a front wall thereof.

* * * * *